US011686184B2

(12) United States Patent
De Mattia et al.

(10) Patent No.: US 11,686,184 B2
(45) Date of Patent: Jun. 27, 2023

(54) OPPORTUNISTIC TECHNIQUES FOR PRODUCTION OPTIMIZATION OF GAS-LIFTED WELLS

(71) Applicant: ExxonMobil Technology and Engineering Company, Spring, TX (US)

(72) Inventors: Marco De Mattia, Houston, TX (US); Mahsa Memarzadeh, Spring, TX (US); Curtis J. Holub, Spring, TX (US); Amr S. El-Bakry, Houston, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 408 days.

(21) Appl. No.: 16/901,455

(22) Filed: Jun. 15, 2020

(65) Prior Publication Data

US 2020/0399999 A1 Dec. 24, 2020

Related U.S. Application Data

(60) Provisional application No. 62/864,208, filed on Jun. 20, 2019.

(51) Int. Cl.
*E21B 43/12* (2006.01)
*E21B 47/008* (2012.01)

(52) U.S. Cl.
CPC ..... *E21B 43/122* (2013.01); *E21B 47/008* (2020.05); *E21B 2200/20* (2020.05)

(58) Field of Classification Search
CPC .... E21B 43/1235; E21B 43/122; E21B 43/14; E21B 47/008; E21B 47/07; E21B 49/008; E21B 2200/20
See application file for complete search history.

(56) References Cited

U.S. PATENT DOCUMENTS

2014/0039793 A1* 2/2014 Querales ..... E21B 47/00 702/6
2016/0053593 A1* 2/2016 Romer ..... E21B 47/06 700/282
2017/0356279 A1* 12/2017 Nandola ..... E21B 47/04
2019/0010792 A1* 1/2019 Arthur ..... E21B 43/168
2019/0353016 A1* 11/2019 Sandidge ..... E21B 47/06

* cited by examiner

*Primary Examiner* — Brad Harcourt
(74) *Attorney, Agent, or Firm* — ExxonMobil Technology and Engineering Company—Law Department

(57) ABSTRACT

A method for producing hydrocarbons in a gas lift well is disclosed. A gas lift rate of the well is monitored while producing hydrocarbons according to an initial gas lift performance curve. One or more well performance parameters for the well are monitored. Disturbances in the well are detected while monitoring the well performance parameters. Transience in the well is modeled. A new gas lift performance curve is derived based on the detected disturbances, the modeled transience, and the initial gas lift performance curve. An optimal allocation of gas lift is determined from the new gas lift performance curve. Hydrocarbons are produced using the determined optimal allocation of gas lift.

19 Claims, 7 Drawing Sheets

OPPORTUNISTIC TECHNIQUES FOR PRODUCTION OPTIMIZATION OF GAS-LIFTED WELLS

CROSS REFERENCE TO RELATED APPLICATIONS

This application claims the priority benefit of U.S. Provisional Patent Application No. 62/864,208, filed Jun. 20, 2019, entitled OPPORTUNISTIC TECHNIQUES FOR PRODUCTION OPTIMIZATION OF GAS-LIFTED WELLS.

FIELD

The present disclosure relates generally to drilling for hydrocarbons. More specifically, the present disclosure relates to gas lift optimization for hydrocarbon assets, which may be conventional or unconventional hydrocarbon assets.

BACKGROUND

Artificial lift is comprised of methods used to transport produced fluids to the surface when reservoir pressure alone is insufficient. Gas lift is a common method that is particularly suited to high-volume offshore wells, but in practice has been found beneficial in increasing production for lower volume unconventional wells as well. A high pressure (up to several thousand psi) gas is injected into the tubing by a casing annulus and travels to a gas lift valve. The operating valve provides a pathway for a designed volume of gas to enter the production tubing. The gas reduces the density of the fluid column, decreasing backpressure on the producing formation. The available reservoir pressure can then force more fluid to the surface. Gas lift valves are effectively pressure regulators and are typically installed during well completion. Multiple gas lift valves may be required to unload completion fluid from the annulus so injected gas can reach the operating valve.

Gas lift is known to be effective, and gas lift wells have generally been proven to be low maintenance. One issue, however, is that gas lift wells remain operational even when they are not optimized. A non-optimized gas lift well will typically still flow production fluids, albeit at a reduced production rate, even if it is receiving too much, or too little, gas lift gas and/or is lifting from multiple valves or a valve above the operating point. Field diagnostics and modeling have estimated that less than 25% of gas lift wells are optimized, resulting in lost production and inefficient allocation of lift gas.

Gas lift performance is typically gauged through periodic well testing. A test separator is commonly used to measure the volume of liquid and gas produced by a well. A typical well test can take four to twelve or more hours. If a change is made to a well, such as increasing or decreasing in the gas lift rate or adjusting a production choke, the well may need several hours to stabilize at a new operating condition before it can be re-tested. One method of optimizing a gas lift well is to select a gas lift rate and test the well, and then repeat the process with additional gas lift rates until a gas lift performance relationship is obtained. The most effective/economic gas lift rate can then be selected. Unfortunately, offshore facilities have a limited amount of space for equipment, so a given production platform or vessel may only have one to two test separators for deployment. If each well must be tested at least monthly for regulatory purposes, the test separator may not be available for gas lift optimization.

Other more technical options for gas lift optimization are not always feasible. For instance, gas lift wells can be modeled with inflow and outflow software and producing pressures and temperatures can be compared to the models. However, this strategy requires accurate models and pressure and temperature transducers located in the flow path. Additionally, the software and sensors must be maintained and periodically recalibrated to ensure accuracy, as well performance changes over time. Multi-phase flow meters could be installed for each individual well, but these tools are relatively expensive and new to the industry.

Further challenges arise when trying to provide a practical and scalable method of optimizing the integrated production of gas lifted unconventional wells. For example, asset size, generally described in terms of the number of wells, is often the major limiting factor for optimizing systems with a large number of wells. Relying exclusively on model-based optimization methods is often not realistic due to the impracticality of generating and maintaining large numbers of well models over their life time. As far as unconventional assets are concerned, build-up testing to measure dynamic reservoir parameters for a given well, such as reservoir pressure or the productivity index, is impractical. Such parameters are essential in maintaining calibrated well models.

As such, there exists a need to address the aforementioned problems and issues. Therefore, what is needed are simpler solutions for gas lift optimization and systems for their implementation.

SUMMARY

In an aspect, a method is provided for producing hydrocarbons in a gas lift well. A gas lift rate of the well is monitored while producing hydrocarbons according to an initial gas lift performance curve. One or more well performance parameters for the well are monitored. Disturbances in the well are detected while monitoring well performance parameters. Transience in the well is monitored. A new gas lift performance curve is derived based on the detected disturbances, the modeled transience, and the initial gas lift performance curve. An optimal allocation of gas lift is determined from the new gas lift performance curve. Hydrocarbons are produced using the determined optimal allocation of gas lift.

In another aspect, a computer system is disclosed. The computer system includes a memory, and a processor in communication with the memory. The processor is programmed to optimize hydrocarbon production in a gas-lifted hydrocarbon well by: monitoring a gas lift rate of the well while producing hydrocarbons according to an initial gas lift performance curve; monitoring one or more well performance parameters for the well; detecting disturbances in the well, the disturbances being detected while monitoring the one or more well performance parameters; modeling transience in the well; deriving a new gas lift performance curve based on the detected disturbances, the modeled transience, and the initial gas lift performance curve; determining an optimal allocation of gas lift from the new gas lift performance curve; and generating an instruction to produce hydrocarbons using the determined optimal allocation of gas lift.

DESCRIPTION OF THE DRAWINGS

The present disclosure is susceptible to various modifications and alternative forms, specific exemplary aspects thereof have been shown in the drawings and are herein described in detail. It should be understood, however, that the description herein of specific exemplary aspects is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary aspects of the present disclosure. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation. The forms disclosed herein are illustrated by way of example, and not by way of limitation, in the figures of the accompanying drawings and in which like reference numerals refer to similar elements and in which:

DETAILED DESCRIPTION

Terminology

Figure 1:
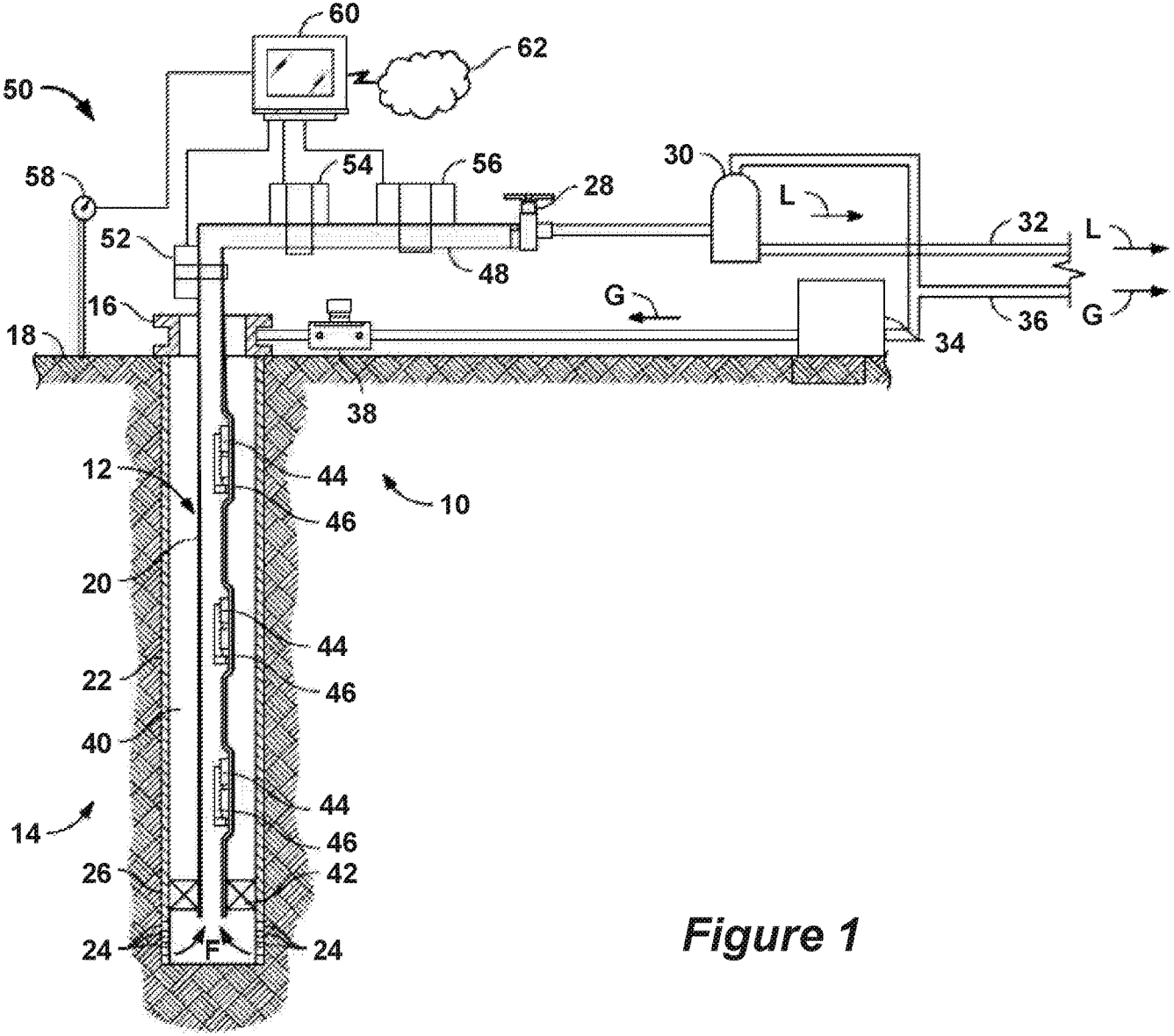
FIG. 1 is a side elevational view of an exemplary gas-lift well according to aspects of the disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

The articles "a" and "an" as used herein mean one or more when applied to any feature in aspects of the present disclosure described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one aspect, to A only (optionally including elements other than B); in another aspect, to B only (optionally including elements other than A); in yet another aspect, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of".

The adjective "any" means one, some, or all indiscriminately of whatever quantity.

As used herein, the phrase "at least one," in reference to a list of one or more elements, means at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one aspect, to at least one, optionally including more than one, A, with no B present (and optionally including elements other than B); in another aspect, to at least one, optionally including more than one, B, with no A present (and optionally including elements other than A); in yet another aspect, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "based on" does not mean "based only on", unless expressly specified otherwise. In other words, the phrase "based on" describes both "based only on," "based at least on," and "based at least in part on."

All transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

"Determining" encompasses a wide variety of actions, and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Reference throughout the specification to "one aspect," "an aspect," "some aspects," or similar construction means that a particular component, feature, structure, method, or characteristic described in connection with the aspect is included in at least one aspect of the claimed subject matter. Thus, the appearance of the phrases "in one aspect" or "in an aspect" or "in some aspects" in various places throughout the specification are not necessarily all referring to the same aspect. Furthermore, the particular features, structures, methods, or characteristics may be combined in any suitable manner in one or more aspects.

The term "exemplary" is used exclusively herein to mean "serving as an example, instance, or illustration." Any aspect described herein as "exemplary" is not necessarily to be construed as preferred or advantageous over other aspects.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different aspects some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on. In some examples, blocks may be implemented in logic. In other examples, processing blocks may represent functions and/or actions performed by functionally equivalent circuits (e.g., an analog circuit, a digital signal processor circuit, an application specific integrated circuit (ASIC)), or other logic device. Blocks may represent executable instructions that cause a computer, processor, and/or logic device to respond, to perform an action(s), to change states, and/or to make decisions. While the figures illustrate various actions occurring in serial, it is to be appreciated that in some examples various actions could occur concurrently, substantially in series, and/or at substantially different points in time. In some examples, methods may be implemented as processor executable instructions. Thus, a machine-readable medium may store processor executable instructions that if executed by a machine (e.g., processor) cause the machine to perform a method.

The word "may" is used throughout this application in a permissive sense (i.e., having the potential to, being able to), not a mandatory sense (i.e., must).

Order of steps: It should also be understood that, unless clearly indicated to the contrary, in any methods claimed herein that include more than one step or act, the order of the steps or acts of the method is not necessarily limited to the order in which the steps or acts of the method are recited.

As used herein, the term "formation" refers to any definable subsurface region. The formation may contain one or more hydrocarbon-containing layers, one or more non-hydrocarbon containing layers, an overburden, and/or an underburden of any geologic formation.

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (20° C. and 1 atm pressure). Hydrocarbon fluids may include, for example, oil, natural gas, gas condensates, coal bed methane, shale oil, shale gas, and other hydrocarbons that are in a gaseous or liquid state.

As used herein, "hydrocarbon management" or "managing hydrocarbons" includes hydrocarbon production, hydrocarbon exploration, identifying potential hydrocarbon resources, identifying well locations, determining well injection and/or extraction rates, identifying reservoir connectivity, acquiring, disposing of and/or abandoning hydrocarbon resources, reviewing prior hydrocarbon management decisions, carbon capture and/or injection, and any other hydrocarbon-related acts or activities.

As used herein, "hydrocarbon production" or "producing hydrocarbons" refers to any activity associated with extracting hydrocarbons from a well or other opening. Hydrocarbon production normally refers to any activity conducted in or on the well after the well is completed. Accordingly, hydrocarbon production or extraction includes not only primary hydrocarbon extraction but also secondary and tertiary production techniques, such as injection of gas or liquid for increasing drive pressure, mobilizing the hydrocarbon or treating by, for example chemicals or hydraulic fracturing the wellbore to promote increased flow, well servicing, well logging, and other well and wellbore treatments.

Math symbols: The following description makes use of several mathematical symbols, many of which are defined as they occur in this description. Additionally, for purposes of completeness, a symbols table containing definitions of symbols used herein is presented following the detailed description.

As used herein, the term "sensor" includes any sensing device or gauge capable of monitoring or detecting pressure, temperature, fluid flow, vibration, resistivity, or other formation and/or fluid data. The sensor may an electrical sensor, an optical sensor, or any other suitable type of sensor. Alternatively, the sensor may be a position sensor.

As used herein, the term "subsurface" refers to geologic strata occurring below the earth's surface.

By "surface mounted sensor" is meant a sensor capable of being mounted to a gas lift well's surface equipment, such as the skin surface of a pipe, tubular or other well component, the sensor capable of conveying information concerning conditions relatable to an aspect of fluid flow, including temperature, pressure, fluid flow rate, vibration, acoustics or the like.

As used herein, the term "unconventional hydrocarbon asset" as used herein refers to any natural source of oil, gas, or other fuel product that is more difficult (for example, requires more energy input) to extract than conventional or "light" oil or gas. One skilled in the art will appreciate that a variety of unconventional hydrocarbon assets are known, although not all may be commercially exploited. Currently known unconventional oil sources include, but are not limited to, heavy oils, tar sands, and oil shale. Currently known unconventional gas sources include, but are not limited to, shale gas, coalbed methane, tight sandstones, and methane hydrates.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

Description

Specific forms will now be described further by way of example. While the following examples demonstrate certain forms of the subject matter disclosed herein, they are not to be interpreted as limiting the scope thereof, but rather as contributing to a complete description.

FIGS. 1-4 provide illustrative, non-exclusive examples of a method and system for optimizing the operation of a gas lift well, according to the present disclosure, together with elements that may include, be associated with, be operatively attached to, and/or use such a method or system for optimizing the operation of a gas lift well.

In the Figures, like numerals denote like, or similar, structures and/or features. Each of the illustrated structures and/or features may not be discussed in detail herein with reference to the figures. Similarly, each structure and/or feature may not be explicitly labeled in the figures; and any structure and/or feature that is discussed herein with reference to the figures may be used with any other structure and/or feature without departing from the scope of the present disclosure.

In general, structures and/or features that are, or are likely to be, included in a given aspect are indicated in solid lines in the figures, while optional structures and/or features are indicated in broken lines. However, a given aspect is not required to include all structures and/or features that are illustrated in solid lines therein, and any suitable number of such structures and/or features may be omitted from a given aspect without departing from the scope of the present disclosure.

Although the approach disclosed herein can be applied to a variety of artificially lifted well designs, the present description will primarily be related to the optimization of a well in which a gas lift system is used to artificially lift the well fluid.

Referring now to FIG. 1, an exemplary gas lift well 10 is illustrated. According to disclosed aspects, gas lift well 10 may be used to produce fluid from a wellbore 12 drilled or otherwise formed in a geological formation 14. A wellbore section of the gas lift system 10 is suspended below a wellhead 16 disposed, for example, at a surface 18 of the earth. A tubing 20 provides a flow path within wellbore 12 through which well fluid F is produced to wellhead 16.

As shown, wellbore 12 is lined with a wellbore casing 22 having perforations 24 through which fluid F flows from formation 14 into wellbore 12. For example, a hydrocarbon-based fluid F may flow from formation 14 through perforations 24 and into wellbore 12 adjacent an intake 26 of tubing 20. Upon entering wellbore 12, the well fluid F is produced upwardly by gas lift system 10 through tubing 20 to wellhead 16. From wellhead 16, the produced well fluid F is directed through control valve 28 to a separator 30 where gas G and liquid L are separated. The substantially liquid portion L of well fluid F may be directed to another location (not shown), such as, by way of example, through conduit 32.

Although gas lift system 10 may comprise a wide variety of components, the example in FIG. 1 is illustrated as having a gas compressor 34 that receives an injection gas from separator 30, and, optionally, from a gas source (not shown). Gas compressor 34 forces the gas through a flow control valve 38, through wellhead 16 and into the annulus 40 between tubing 20 and casing 22. A packer 42 is designed to seal annulus 40 around tubing 20. In some aspects, packer 42 is disposed proximate intake 26, as shown.

The pressurized gas G flows through the annulus 40 and is forced into the interior of tubing 20 through one or more gas lift valves 44, which may be disposed, for example, in corresponding side pocket mandrels 46. The gas flowing through gas lift valves 44 draws well fluid into intake 26 and upwardly through the interior of tubing 20. The mixture of injected gas G and well fluid F move upwardly through control valve 28 and are separated at separator 30 which directs the injection gas G back to gas compressor 34, and the liquid L, comprising a mixture of hydrocarbons and water, through conduit 32 for further processing.

As may be appreciated, well fluid F combined with injected gas lift gas G comprises a multiphase fluid, resulting in a major portion of gas and a minor portion of liquids at surface flowline conditions. In some aspects, well fluid F may comprise greater than about 50% gas and less than about 50% liquids, or about 60% gas and about 40% liquids, or about 70% gas and about 30% liquids, or about 80% gas and about 20% liquids, or about 90% gas and about 10% liquids, or about 95% gas and about 5% liquids or greater than about 95% gas and less than about 5% liquids. There may be production periods where well fluid F may comprise substantially all gas, with intermittent or varying liquid production periods. The term multiphase fluid merely refers to a fluid that in some aspects or occasions may have multiple phases present, while during other aspects or occasions may comprise substantially 100% gas. The phase category of gas or liquid is determined at or near the well surface or wellhead.

Aspects disclosed herein require well performance data to be obtained from one or more gas lift wells. An exemplary method of obtaining such well performance data, using well temperature data, may be found in commonly owned U.S. Pat. No. 10,012,059, the disclosure of which is incorporated by reference herein. Other methods of obtaining well performance data may be used as desired. Still referring to FIG. 1, a system 50 for optimizing the operation of a gas lift well 10 is depicted. System 50 includes one or more surface mounted sensors. The one or more surface mounted sensors include at least one temperature sensor 52, which may be a temperature transducer, thermocouple, thermistor, resistance temperature detector (RTD), or the like. In some aspects, the at least one surface mounted sensor includes a plurality of surface mounted sensors, such as an acoustic sensor 54 and a sensor 56. Each of the plurality of surface mounted sensors may be mounted to the gas lift well's surface equipment, such as, by way of example and not of limitation, a production conduit 48. System 50 may also include an ambient temperature sensor 58 positioned so as to monitor ambient temperature conditions at or near the well 10.

To process data obtained from the plurality of surface mounted sensors 52, 54 and/or 56, and the ambient temperature sensor 58, a computer 60 comprising storage means (not shown) and a processor for processing (not shown) may be employed. Computer 60 may be operatively connected to the internet to transmit data for monitoring and/or storage to a remote or cloud server 62. As may be appreciated by those skilled in the art, computer 60 may be present at the well site, as shown, or the data transmitted to a remote location via satellite, wireless, telephonic or other means of transmission. Computer 60 is programmed to determine gas lift performance from the data obtained from the plurality of surface mounted sensors 52, 54 and/or 56, and the ambient temperature sensor 58. In some aspects, computer 60 may be programmed to adjust the data obtained from the temperature sensor 52 for ambient temperature measurements obtained from the ambient temperature sensor 58.

The disclosed aspects provide a method for optimizing the production of gas lifted wells by using disturbances in the gas lift rate, while capturing system transience, i.e., natural variability over time, thus eliminating the need for build-up tests to measure reservoir properties. Such disturbances may happen due to natural or forced operations of the system. The disclosed aspects allow for dynamic derivation (meaning that the method runs continuously and re-derives the gas lift performance curve whenever needed) of the response of a conventional or an unconventional well to gas lift injection rate, also known as a gas lift performance curve, from transient well data and in an opportunistic fashion. In this context, 'opportunistic' means that the method derives the response of the well to gas lift rate changes that may not have been planned or intentional, along with its associated quality metric. The opportunities have been noted to arise from natural operations of the gas compressor resulting in unintentional variations in gas lift injection rate over longer periods of time. Well transience is a known operational state during the production of hydrocarbon assets, which is even more pronounced for unconventional assets, where hydrocarbons may be produced through fractures in a tight reservoir. The derived gas lift performance curves from the disclosed aspects may be used to optimize the integrated production of a collection of wells, by optimally allocating the available gas compressor capacity to different wells, and in view of other well and facility constraints, using a new gas lift performance curve that passes a model quality criterion. Specifically, any overall system constraint, such as the total gas compression capacity or facilities' production handling constraints, in addition to individual well constraints, can be accounted for while determining the optimal allocation of gas lift to the wells. The derivation of the gas lift performance curve may be implemented through direct monitoring of various well performance parameters such as pressure, rate, or temperature, or through indirect or inferred production measures, such as a liquid flow rate inferred from temperature data. In situations where the natural disturbances are not enough to identify the well response, as indicated by the model quality criterion, the need for a manual or forced disturbance is identified. The manual or forced disturbance may be implemented in terms of a multi-rate well test. Additionally, the optimal gas lift injection rate may be adjusted if the production uplift opportunity exceeds a threshold, such as a minimal percent change in the downhole pressure or a minimal increase in the expected oil production.

The methods disclosed herein provide a technique for determining the response of the well to gas lifting from well data accounting for the well transient behavior (such as the drop in downhole pressure as the well is produced or the delayed response of the downhole pressure to changes in gas lift rate). Changes in gas lift rate, intentional or not, over an extended period of time, are used to extract the response of the well.

The following model of downhole pressure (p) as a function of time and gas lift rate (q) is fit to the data:

$$p(t, q) = L(t) + \sum_i S_i(t, q),$$

where $$L(t) = \text{slope} \cdot t + \text{intercept}$$

models a linear drop of downhole pressure as a function of time as the well is produced. This drop is observed at constant gas lift rate and is found to be a good approximation for periods of typically a few months. The second term represents the time-superposition of terms in the form:

$$S_i(t,q)=TS_i t)\cdot\Delta p_i(q)\cdot R_i(t),$$

where $$\Delta p_i(q)=p(q(t_i))-p(q(t_{i-1)})$$

Because we are making use of time-superposition, the downhole pressure at time t depends on the full or partial history of changes to the gas lift rate q. The downhole pressure response is described by a gas lift rate curve p(q) assumed to be constant over the analysis interval. The parametric form used in the results shown here is:

$$p(q)=aq^2+bq.$$

The gas lift performance curve p(q) is multiplied by a time-dependent term R(t) to model the relaxation-like response of the downhole pressure to changes in the gas lift rate q over time. The functional form of the time-dependent term R(t) used herein is:

$$R(t) = \left[\frac{t - t_0}{\tau + (t - t_0)}\right]^d$$

where $t_0$ is the time of the change of the gas lift rate q, $\tau$ is a parameter controlling the speed of the propagation of the change in downhole pressure p, and d controls the shape of the response curve. In addition, a time scaling term TS(t) is added to allow shrinking or expanding the height of the gas lift performance curve p(q). The form of the time scaling term TS(t) is:

$$TS(t)=1-\text{scale}\cdot(t_0-t_{initial}),$$

where $t_{initial}$ is the time at the start of the history of changes to the gas lift rate q, so that the time scaling term TS(t) is equal to one (no scaling) at that time. The scale parameter controls the amount as well as the direction (shrinking or expanding) of the scaling.

The explicit functional forms shown above are the baseline forms used for the aspects described herein. However, other forms for L(t), p(q), R(t), and TS(t) can be used to adapt the model to varying well conditions. Furthermore, the method is applicable to quantities other than downhole pressure, such as liquid rate or temperature, with appropriate changes of those functional forms.

The system is implemented in a real-time and automatic fashion, where well data is continuously pulled and analyzed to 1) make a determination of the presence of changes to the gas lift rate q, 2) if enough changes are available since the last update, derive a new gas lift performance curve p(q), and if not, to initiate manual or forced changes to the gas lift rate, and 3) optimize production by calculating the optimal allocation of gas lift from the new gas lift performance curve p(q). Though the actions can be implemented in a closed-loop fashion, a production or operations engineer can potentially monitor system results and make the final call on all the actionable items.

Figure 2:
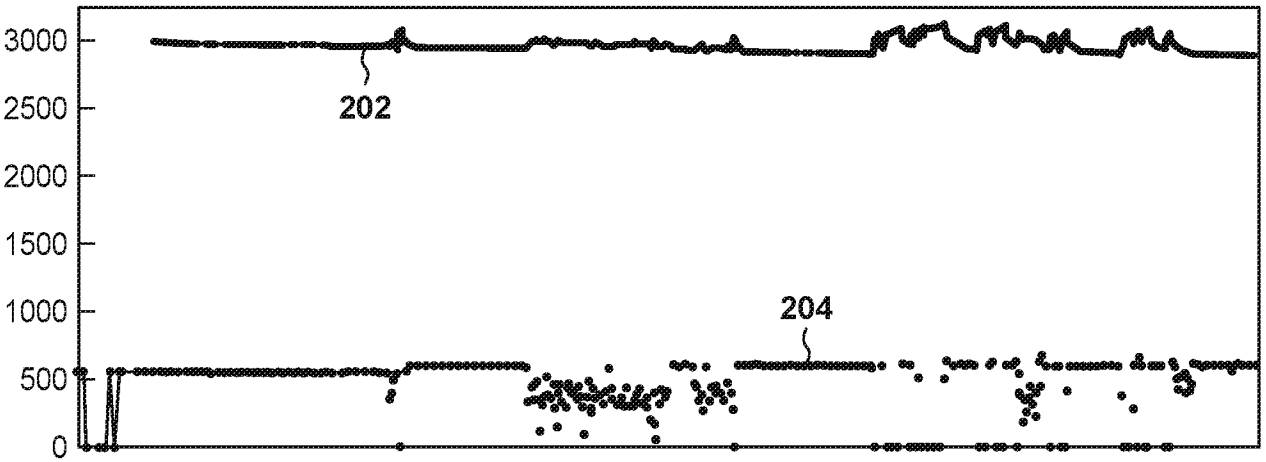
FIG. 2 is a chart showing sample pressure and flow data according to disclosed aspects.
Figure 3:
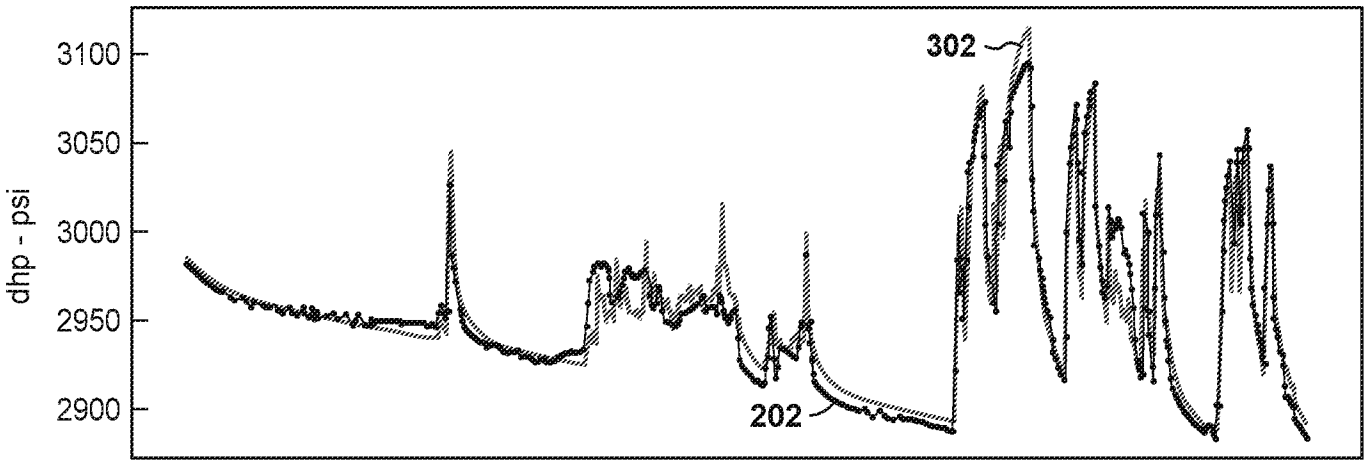
FIG. 3 is a magnified view of the pressure data of FIG. 2.

To demonstrate the disclosed aspects, FIGS. 2 and 3 graphically depict one month of historical pressure and flow data. In FIG. 2, downhole pressure is shown by line 202 and observed gas lift rates are shown by the series of data points 204. In FIG. 3, which depicts the downhole pressure data 202 in much greater detail, the "ratio power law" curve 302 represents the downhole pressure estimated from the disclosed model based on the values 204 for the gas lift rate q. FIG. 3 demonstrates that the ratio power law curve 302 reasonably captures the transient behavior caused by multiple gas lift stops and restarts.

The assumptions made in the model describe the value of the downhole pressure at any given time as dependent on the history of the changes to the gas lift rate q and on an overall decline independent of the gas lift rate. For this reason, given a certain gas lift rate q, the value of the downhole pressure p is not univocally defined. However, given a history-matched model, both the L(t) term and all contributions from previous gas lift rate q changes may be subtracted from the observed downhole pressure to obtain the predicted Δp due only to the last change of the gas lift rate q using $$\Delta p(q(t)) = p_{observed} - L(t) - \sum_{i}^{n-1} S_i(t, q),$$

where the sum of the $S_i$ terms represents the superposition of all the downhole pressure changes due to gas lift rate (q) changes prior to the most recent one. The value of the downhole pressure that can be compared to the gas lift performance curve p(q) is finally obtained as:

$$p(q(t_i))=\Delta p(q(t_i))+p(q(t_i-1)),$$

where the last equation follows from the definition of Δp.

Figure 4:
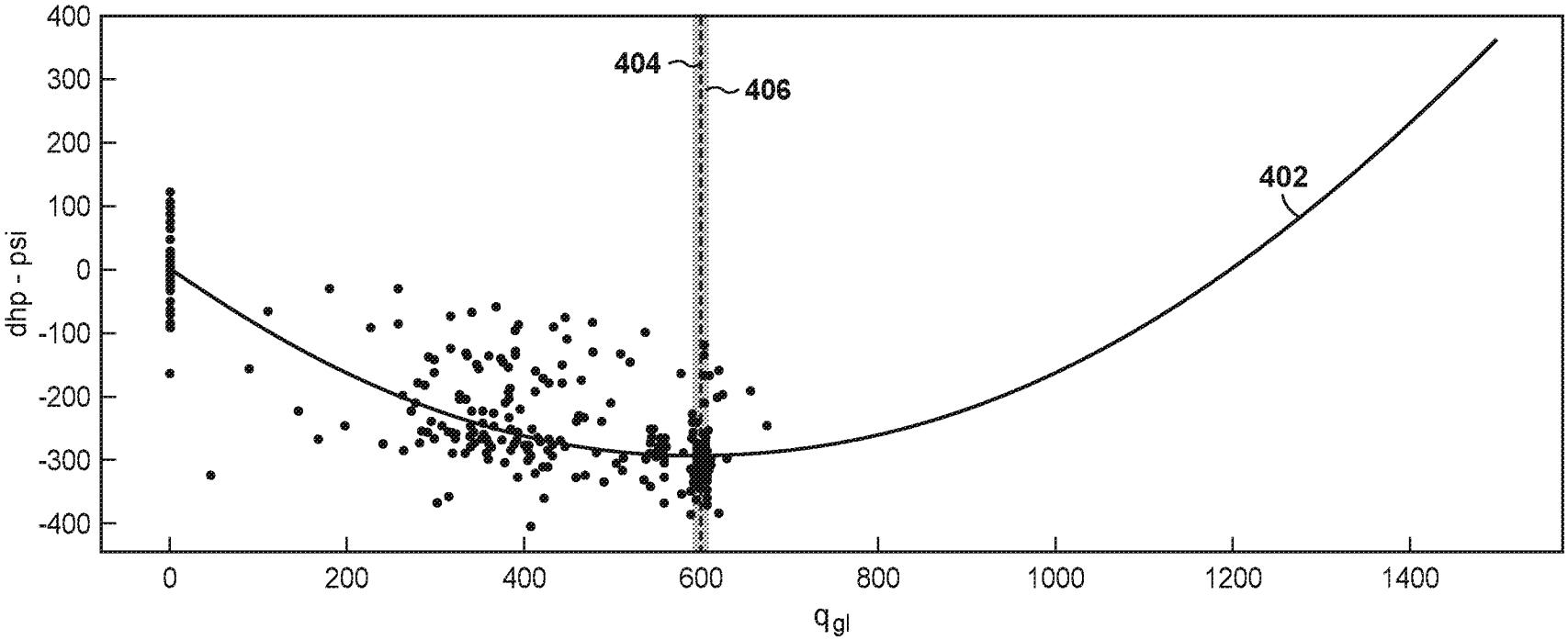
FIG. 4 is a gas lift performance curve generated in accordance with the disclosed aspects.

Results of the model fit to historical well data are shown in FIG. 4, in which the ratio power law curve 402 represents the gas lift performance curve extracted by the disclosed model. The vertical dashed line 404 represents the position of the minimum downhole pressure and the shaded area 406 around the line represents a 'one sigma' statistical uncertainty on that position. Even though there were no scheduled multi-rate tests in the historical data considered for the model fit, the disclosed method allows a gas lift performance curve to be extracted from the multiple gas lift variations due to compressor instabilities or other causes. A covariance matrix may be estimated by the fit and is utilized to determine a quality criterion that represents the quality of the derived quantities. A low quality criterion can be due to an insufficient number and/or range of changes in the gas lift rate in the considered time period. A low quality criterion may be due to a low quality of fit on monitored well performance parameters, as defined herein. The fit quality can then be used in a decision to schedule manual or forced disturbances in the gas lift rate. Whenever a new gas lift performance curve is successfully derived a new optimal gas lift rate is obtained. The new optimal point is implemented in the well only if the expected change in the uplift exceeds a threshold.

Figure 5:
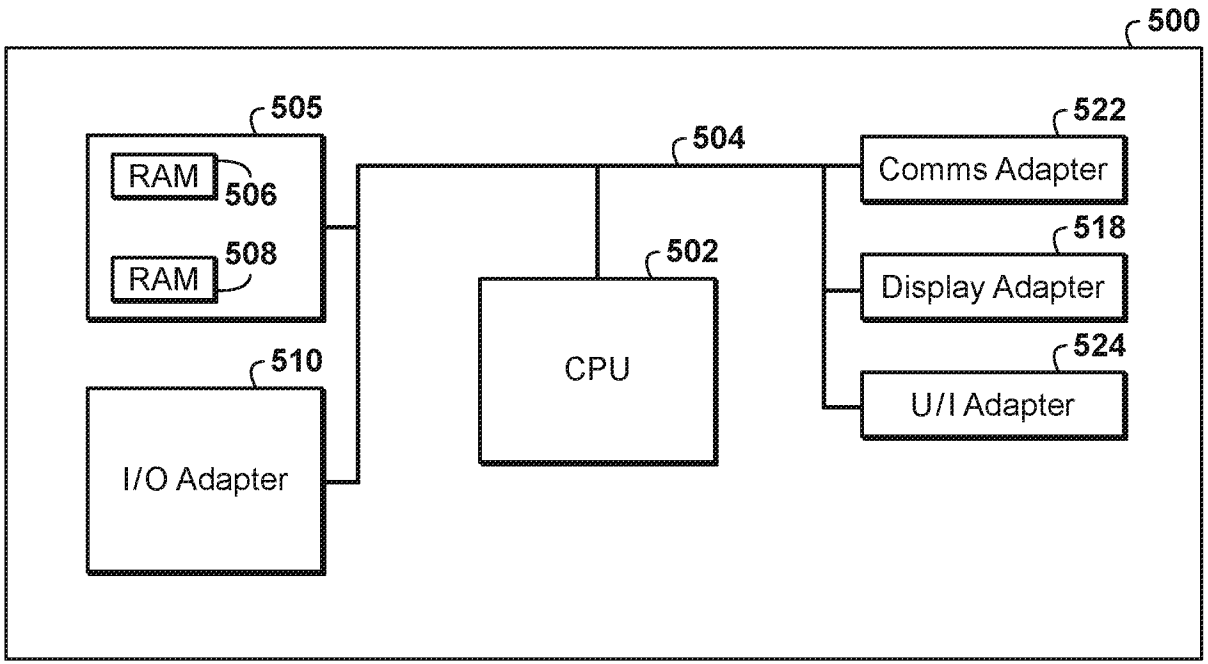
FIG. 5 is a block diagram of a general purpose computer system that may be used with the disclosed aspects.

One or more steps of the disclosed aspects may be accomplished using a computing device. For example, a computing device is particularly suited for automating repeated calculations necessary to calculate gas lift rates and flow rate curves as disclosed herein. One of ordinary skill in the art will readily understand how to employ a computing device to accomplish various aspects of the disclosure. FIG. 5 is a block diagram of a general purpose computer system 500 suitable for implementing one or more aspects of the components described herein. In some disclosed aspects, the computer system 500 may comprise the architecture of computer 60 shown in FIG. 1. The computer system 500 includes a central processing unit (CPU) 502 coupled to a system bus 504. The CPU 502 may be any general-purpose CPU or other types of architectures of CPU 502 (or other components of exemplary system 500), as long as CPU 502 (and other components of system 500) supports the operations as described herein. Those of ordinary skill in the art will appreciate that, while only a single CPU 502 is shown in FIG. 5, additional CPUs may be present. Moreover, the computer system 500 may comprise a networked, multi-processor computer system that may include a hybrid parallel CPU/Graphics Processing Unit (GPU) system (not depicted). The CPU 502 may execute the various logical instructions according to various aspects. For example, the CPU 502 may execute machine-level instructions for performing processing according to the operational flow described above in conjunction with FIGS. 1-4.

The computer system 500 may also include computer components such as non-transitory, computer-readable media or memory 505. The memory 505 may include a RAM 506, which may be SRAM, DRAM, SDRAM, or the like. The memory 505 may also include additional non-transitory, computer-readable media such as a Read-Only-Memory (ROM) 508, which may be PROM, EPROM, EEPROM, or the like. RAM 506 and ROM 508 may hold user data, system data, data store(s), process(es), and/or software, as known in the art. The memory 505 may suitably store predefined configuration data and/or placement information, e.g., predefined configuration data and/or placement information as described in connection with FIGS. 1-4. The computer system 500 may also include an input/output (I/O) adapter 510, a communications adapter 522, a user interface adapter 524, and a display adapter 518.

The I/O adapter 510 may connect one or more additional non-transitory, computer-readable media such as an internal or external storage device(s) (not depicted), including, for example, a hard drive, a compact disc (CD) drive, a digital video disk (DVD) drive, a floppy disk drive, a tape drive, and the like to computer system 500. The storage device(s) may be used when the memory 505 is insufficient or otherwise unsuitable for the memory requirements associated with storing data for operations of aspects of the present techniques. The data storage of the computer system 500 may be used for storing information and/or other data used or generated as disclosed herein. For example, storage device(s) may be used to store configuration information or additional plug-ins in accordance with an aspect of the present techniques. Further, user interface adapter 524 may couple to one or more user input devices (not depicted), such as a keyboard, a pointing device and/or output devices, etc. to the computer system 500. The CPU 502 may drive the display adapter 518 to control the display on a display device (not depicted), e.g., a computer monitor or handheld display, to, for example, present information to the user regarding location.

The computer system 500 further includes communications adapter 522. The communications adapter 522 may comprise one or more separate components suitably configured for computer communications, e.g., one or more transmitters, receivers, transceivers, or other devices for sending and/or receiving signals. The computer communications adapter 522 may be configured with suitable hardware and/or logic to send data, receive data, or otherwise communicate over a wired interface or a wireless interface, e.g., carry out conventional wired and/or wireless computer communication, radio communications, near field communications (NFC), optical communications, scan an RFID device, or otherwise transmit and/or receive data using any currently existing or later-developed technology. In some aspects, the communications adapter 522 is configured to receive and interpret one or more signals indicating location, e.g., a GPS signal, a cellular telephone signal, a wireless fidelity (Wi-Fi) signal, etc.

The architecture of system 500 may be varied as desired. For example, any suitable processor-based device may be used, including without limitation personal computers, laptop computers, computer workstations, and multi-processor servers. Moreover, aspects may be implemented on application specific integrated circuits (ASICs) or very large scale integrated (VLSI) circuits. Additional alternative computer architectures may be suitably employed, e.g., using one or more operably connected external components to supplement and/or replace an integrated component. In fact, persons of ordinary skill in the art may use any number of suitable structures capable of executing logical operations according to the aspects. In an aspect, input data to the computer system 500 may include various plug-ins and library files. Input data may additionally include configuration information.

Figure 6:
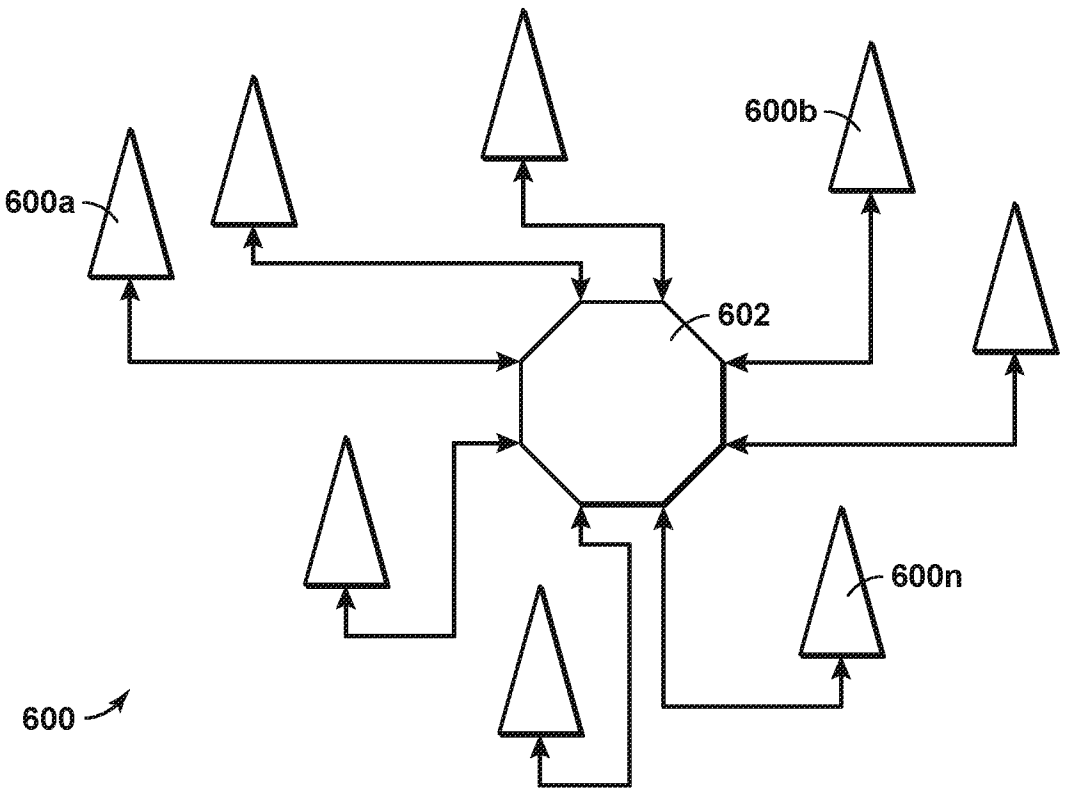
FIG. 6 is a schematic diagram of a collection of wells in which the disclosed aspects may be used.

FIG. 6 is a schematic diagram representing a collection or a plurality 600 of wells 600*a*, 600*b*, . . . 600*n* that may be controlled using the disclosed aspects. The central area 602 represents control functions and systems that may be centrally located (as shown) or may be distributed throughout the collection of wells. According to disclosed aspects, the gas lift rate of one or more wells may be monitored while producing hydrocarbons from one or more of the wells. A disturbance of well conditions is detected. The disturbance may be a change in the gas lift rate, wellhead pressure, or other monitored well parameters. A new gas lift performance curve may be derived that is based on the detected disturbances and an initial gas lift performance curve. This derivation accounts for or filters out transient behavior of the well, which in an aspect may comprise the downhole pressure unaffected by changes to the gas lift rate, and may also comprise interim reactions of the downhole pressure to changes in the well. Using the new gas lift performance curve, an optimal allocation of gas lift may be determined for one or more of the wells, and hydrocarbons may be produced based on the optimal allocation. Such allocation may be directed to a single well or to multiple wells, thereby enabling an efficient and optimal distribution of field resources (such as compression power) over multiple wells.

Figure 7:
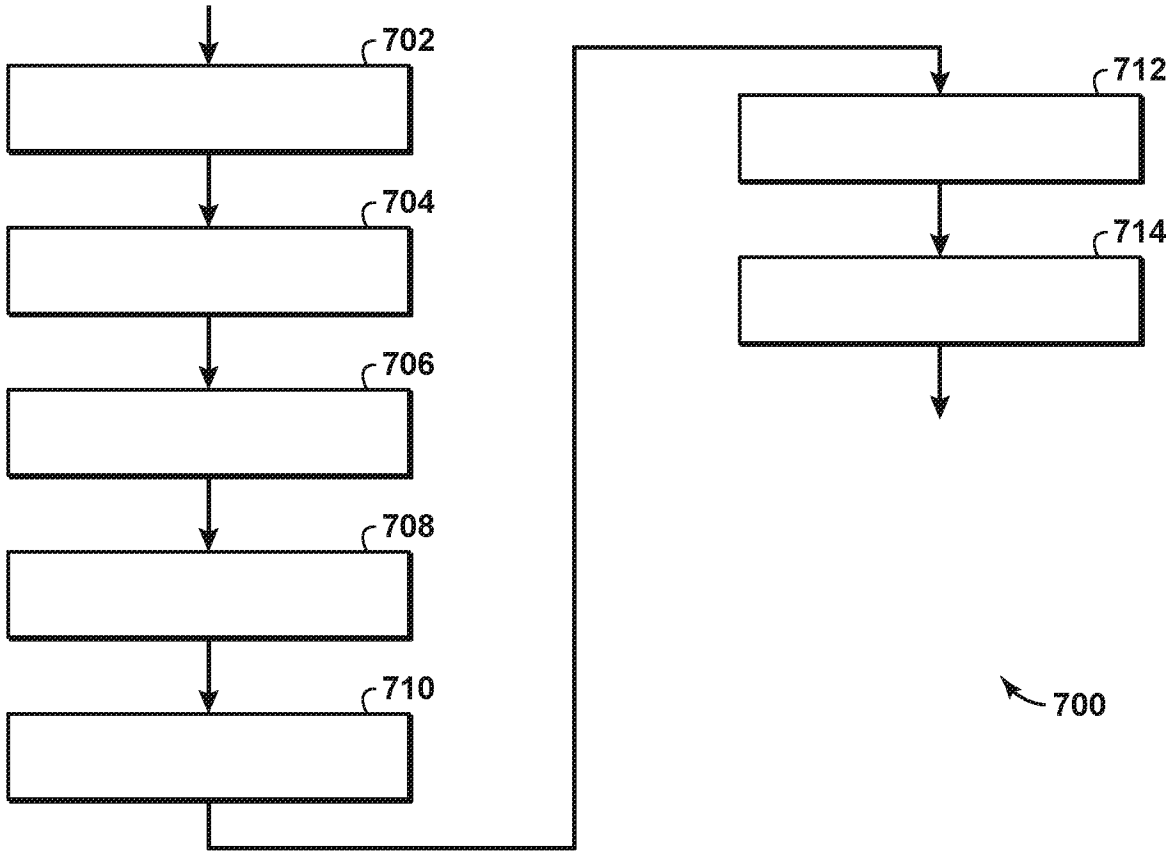
FIG. 7 is a flowchart of a method of producing hydrocarbons in a well according to disclosed aspects.

FIG. 7 is a flowchart showing a method 700 for producing hydrocarbons in a well according to aspects of the disclosure. Part or all of method 700 may be performed by a computer system, such as computer system 500. At block 702 a gas lift rate of the well is monitored while producing hydrocarbons according to an initial gas lift performance curve. The initial gas lift performance curve may be generated by analyzing historical well performance data. At block 704 one or more well performance parameters are monitored. The well performance parameters may include downhole pressure, wellhead pressure, fluid flow rate, temperature of fluid either downhole or at the wellhead, or any other parameter that provides information relating to the performance of the well. The well performance parameters may be directly measured, calculated, or inferred from other parameters. At block 706 disturbances in the well are detected while monitoring the one or more well performance parameters. The disturbances may comprise one or more changes in the gas lift rate. The disturbances may include changes to a choke of the control valve that controls gas lift injection. The disturbances may include changes to a point of gas lift injection. The disturbances may include changes to a production parameter such as water cut, gas oil ratio, and/or fluid properties measured through well tests or fluid tests. At block 708 transience in the well is modeled. Transience may be defined by the time-based changes to monitored well parameters due to depletion, and/or from the delayed effect or impact a disturbance may have on a monitored well performance parameter. At block 710 a new gas lift performance curve is derived based on the detected disturbances, the modeled transience, and the initial gas lift performance curve. At block 712 an optimal allocation of gas lift is determined from the new gas lift performance curve. At block 714 hydrocarbons are produced using the determined optimal allocation of gas lift. This may be done using the determined optimal allocation of gas lift is accomplished if the determined optimal allocation of gas lift exceeds a quality criterion. The quality criterion may be based on the number of changes in the gas lift rate in a given time period (e.g., 24 hours, one week, one month, etc.). Additionally or alternatively, the quality criterion may be based on a range of the changes in the gas lift rate in a given time period (e.g., 24 hours, one week, one month, etc.). The quality criterion may also be based on a quality of fit on monitored well performance parameters.

Figure 8:
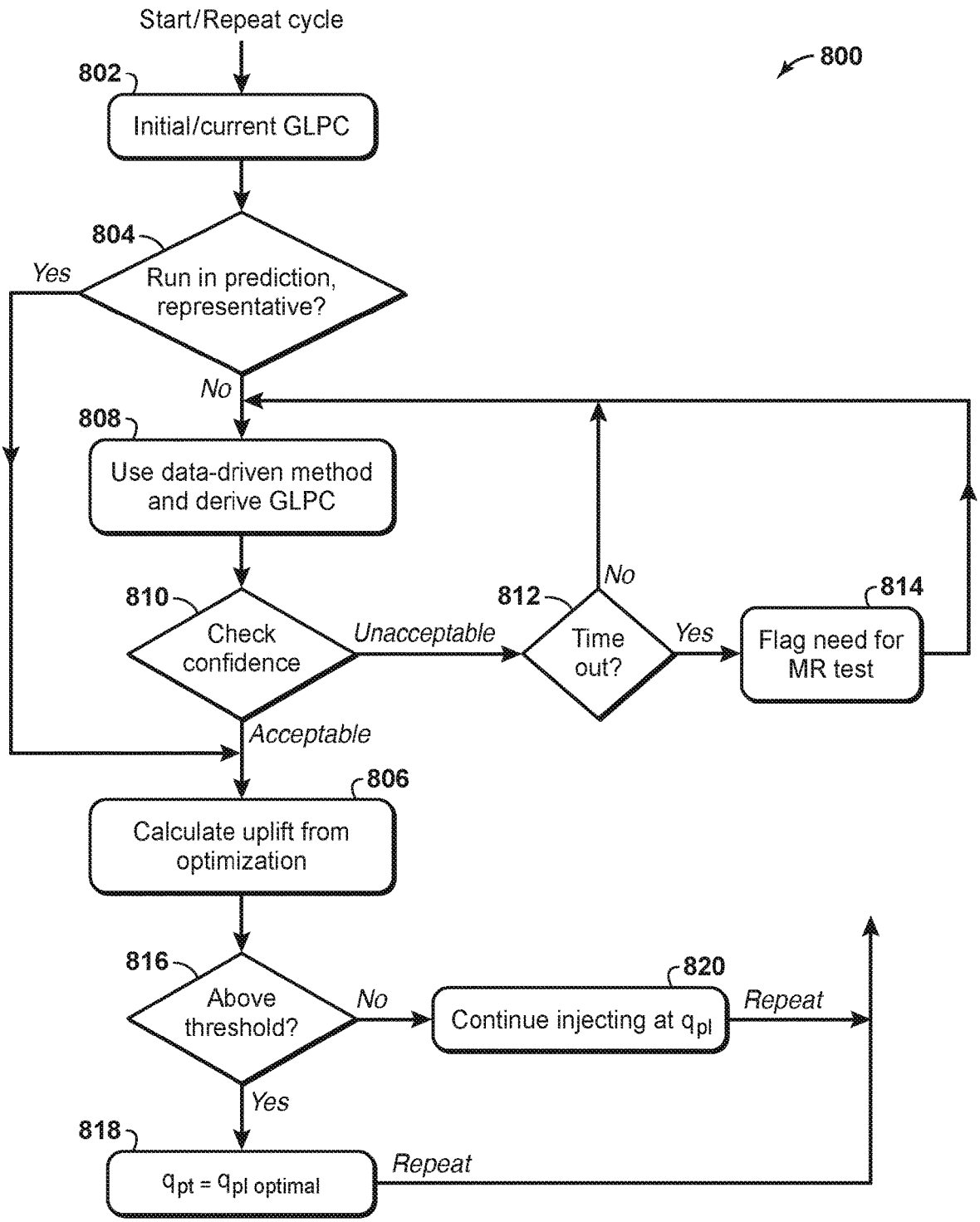
FIG. 8 is a flowchart of a method according to disclosed aspects.

FIG. 8 is a flowchart showing a method 800 for using a data-driven approach to deriving a well performance model for gas lifting, also referred to as a gas lift performance curve (GLPC). Method 800 is designed to be run in a cyclical fashion, either continuously, once per designated time period, or by a condition-based trigger. Alternatively, the method may be run for a finite number of iterations or for a selected amount of time. The method starts at block 802, at which an initial or current GLPC is obtained. At block 804 it is determined whether the initial or current GLPC continues to be representative of the well performance model. This may be accomplished by comparing the calculated output of the model for the measurement used for fitting with the actual data obtained from the well or wells being modeled. If the results of this comparison are within an acceptable range (i.e., the initial/current GLPC is consistent with the data), then the method moves to block 806, where gas lift is calculated from optimization as previously discussed herein. If the initial/current GLPC is not within an acceptable range, then at block 808 a data-driven method, as described herein, is employed to programmatically construct/build a new GLPC. This programmatical construction/building can equally exploit natural disturbances of gas lift injection rate due to, for example, gas compressor operational variations, as well as planned/scheduled multi-rate tests that involve enforcing intentional variations of the gas lift injection rate. If natural disturbances are non-existent or insufficient to render a representative GLPC with acceptable confidence (block 810) within a reasonable time (block 812), a need for a multi-rate test is flagged (block 814) and subsequently acted upon according to, for example, the methodology described in co-pending and commonly-owned U.S. patent application Ser. No. 16/702,827, "Method and System for Unconventional Gas Lift Optimization," the disclosure of which is incorporated by reference herein in its entirety. The new multi-rate test is used with the aforementioned data-driven method to programmatically construct a new GLPC (block 808). At block 816 the uplift potential for each well resulting from optimizing the gas lift injection rate is monitored, and if the uplift potential is above a threshold, at block 818 the gas lift injection rate is changed to the optimal gas lift injection rate. Otherwise, at block 820 the gas lift injection rate is maintained at its previously derived quantity, thereby rendering the system close to its optimal state. Regardless of whether the gas injection lift rate is maintained, the method returns to block 802 and repeats.

INDUSTRIAL APPLICABILITY

The apparatus and methods disclosed herein are applicable to the oil and gas industry.

Table of Mathematical Symbols Used Herein:

| | |
|---|---|
| a, b | parameters for p(q) |
| D | response curve shape parameter |
| L(t) | linear drop in downhole pressure |
| P | downhole pressure |
| p(q) | gas lift rate curve |
| $p_{observed}$ | observed downhole pressure |
| Q | gas lift rate |
| R(t) | relaxation-like response |
| scale | scaling parameter |
| $S_i$ | superposition term |
| $t_0$ | time of the change of the gas lift rate |
| $t_{initial}$ | time at start of change history to q |
| TS(t) | time scaling term |
| $\tau$ | propagation speed parameter |

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method for producing hydrocarbons in a gas lift well, comprising:

monitoring a gas lift rate of the well while producing hydrocarbons according to an initial gas lift performance curve;

monitoring one or more well performance parameters for the well;

detecting disturbances in the well, the disturbances being detected while monitoring the one or more well performance parameters;

identifying a need for a forced disturbance in the well when the detected disturbances do not provide sufficient information to derive the initial gas lift performance curve;

modeling transience of the well;

deriving a new gas lift performance curve based on the detected disturbances, the modeled transience, and the initial gas lift performance curve;

determining an optimal allocation of gas lift from the new gas lift performance curve; and producing hydrocarbons using the determined optimal allocation of gas lift.

2. The method of claim 1, wherein producing hydrocarbons using the determined optimal allocation of gas lift comprises injecting an amount of gas into the well based on the new gas lift performance curve.

3. The method of claim 1, wherein the well is one of a collection of wells, and further wherein determining an optimal allocation of gas lift from the new gas lift performance curve comprises determining an optimal allocation of gas lift for at least two of the collection of wells, and further wherein hydrocarbons are produced from the collection of wells using the determined optimal allocation of gas lift.

4. The method of claim 1, wherein the gas lift well is one of a collection of wells, and further comprising:

monitoring a gas lift rate for each well of the collection of wells;

monitoring one or more well performance parameters for said each well;

detecting a disturbance in at least one of the collection of wells;

modeling transience for said each well;

deriving a new gas lift performance curve for each well of the collection of gas lift wells based on the detected disturbances and the initial gas lift performance curve of the gas lift well;

determining an optimal allocation of gas lift for the collection of wells from the new gas lift performance curve; and injecting an amount of gas into one or more of the collection of wells based on the new gas lift performance curve.

5. The method of claim 1, wherein the initial gas lift performance curve is a current representation of production in the well, and wherein the revised gas lift performance curve is a revised representation of production in the well.

6. The method of claim 1, wherein a control valve is associated with the well, and wherein gas is injected into the well by controlling the control valve.

7. The method of claim 1, further comprising:

generating the initial gas lift performance curve from an initial well model or by analyzing historical well performance data.

8. The method of claim 1, wherein the disturbances comprise at least one of changes in gas lift rate, changes to a choke, changes to a point of gas lift injection, and changes to a production parameter, wherein the production parameter is selected from water cut, gas oil ratio, and fluid properties measured through well tests or fluid tests.

9. The method of claim 1, wherein the well transience is modeled based on changes in the one or more well performance parameters as hydrocarbons are produced from the well, and a delayed response of the well performance parameters to changes in gas lift rate or other detected disturbances in the well.

10. The method of claim 1, wherein the forced disturbance comprises an intentional change to gas lift rate.

11. The method of claim 1, wherein producing hydrocarbons using the determined optimal allocation of gas lift is accomplished if the determined optimal allocation of gas lift exceeds a quality criterion that is based on at least one of a number of changes in the gas lift rate in a given time period, a range of changes in the gas lift rate in the given time period, and a quality of fit on monitored well performance parameters.

12. A computer system, comprising:

a memory; and a processor in communication with the memory, the processor programmed to optimize hydrocarbon production in a gas-lifted hydrocarbon well while hydrocarbons are being produced by monitoring a gas lift rate of the well while producing hydrocarbons according to an initial gas lift performance curve;

monitoring one or more well performance parameters for the well;

detecting disturbances in the well, the disturbances being detected while monitoring the one or more well performance parameters;

identifying a need for a forced disturbance in the well when the detected disturbances do not provide sufficient information to derive the initial gas lift performance curve;

modeling transience of the well;

deriving a new gas lift performance curve based on the detected disturbances, the modeled transience, and the initial gas lift performance curve;

determining an optimal allocation of gas lift from the new gas lift performance curve; and generating an instruction to produce hydrocarbons using the determined optimal allocation of gas lift, wherein hydrocarbons are produced according to the determined optimal allocation of gas lift.

13. The computer system of claim 12, wherein the processor is further programmed to generate an instruction to inject an amount of gas into the well based on the new gas lift performance curve.

14. The computer system of claim 12, wherein the well is one of a collection of wells, and further wherein determining an optimal allocation of gas lift from the new gas lift performance curve comprises determining an optimal allocation of gas lift for at least two of the collection of wells, and further comprising:

generating an instruction to produce hydrocarbons from the collection of wells using the determined optimal allocation of gas lift.

15. The computer system of claim 12, wherein the gas lift well is one of a collection of wells, and further wherein the processor is programmed to:

monitor a gas lift rate for each of more than one well of the collection of wells;

detect a disturbance in more than one of the collection of wells;

derive a new gas lift performance curve for the gas lift well based on the detected disturbances and the initial gas lift performance curve of the gas lift well;

determine an optimal allocation of gas lift for the collection of wells from the new gas lift performance curve; and generate an instruction to inject an amount of gas into one or more of the collection of wells based on the new gas lift performance curve.

16. The computer system of claim 12, wherein the initial gas lift performance curve is a current representation of production in the well, and wherein the revised gas lift performance curve is a revised representation of production in the well.

17. The computer system of claim 12, wherein the processor is further programmed to generate the initial gas lift performance curve by analyzing historical well performance data.

18. The computer system of claim 12, wherein the disturbances comprise at least one of changes in gas lift rate, changes to a choke, changes to a point of gas lift injection, and changes to a production parameter, wherein the production parameter is selected from water cut, gas oil ratio, and fluid properties measured through well tests or fluid tests.

19. The computer system of claim 12, wherein the processor is further programmed to generate an instruction to identify a need for a forced disturbance in the well when the detected disturbances do not provide sufficient information to derive the gas lift performance curve.

* * * * *